United States Patent [19]

Miyasaka et al.

[11] 4,117,658

[45] Oct. 3, 1978

[54] WATERPROOF WATCH CASE

[75] Inventors: Tsutomu Miyasaka; Yoshiaki Fujimori; Shigeru Matsui; Tetsuo Komaki, all of Suwa, Japan

[73] Assignee: Kabushiki Kaisha Suwa Seikosha, Tokyo, Japan

[21] Appl. No.: 721,146

[22] Filed: Sep. 7, 1976

[30] Foreign Application Priority Data

Sep. 5, 1975 [JP] Japan ..... 50-108435

[51] Int. Cl.[2] ..... G04B 37/08; G04B 39/00

[52] U.S. Cl. ..... 58/90 R; 58/91

[58] Field of Search ..... 58/88 R, 90 R, 91

[56] References Cited

U.S. PATENT DOCUMENTS

| | | | |
|---|---|---|---|
| 2,566,741 | 9/1951 | Newhouse | 58/91 |
| 3,355,875 | 12/1967 | Jeanmonod et al. | 58/91 |
| 3,841,085 | 10/1974 | Akahane | 58/90 R |
| 3,849,981 | 11/1974 | Tarusawa et al. | 58/90 R |
| 3,950,937 | 4/1976 | Fujimori | 58/90 R |

*Primary Examiner*—Stanley J. Witkowski

*Attorney, Agent, or Firm*—Blum, Moscovitz, Friedman & Kaplan

[57] ABSTRACT

A waterproof watch case construction depends on gaskets alone for waterproofing and is free of cement. The construction is such that a broken crystal can be readily replaced, and the watch case itself can be of any shape, including square, ovoid and hexagonal, as well as circular. The watch crystal is located positively by means of a bezel and a ring which compress a gasket both axially and radially against the watch crystal.

6 Claims, 14 Drawing Figures

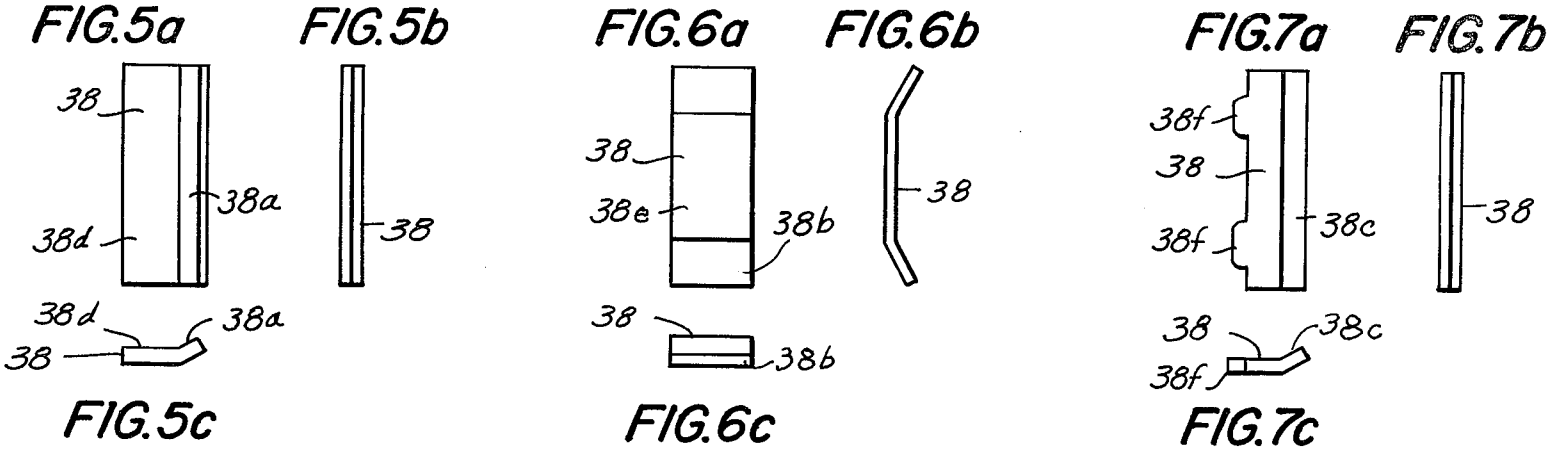
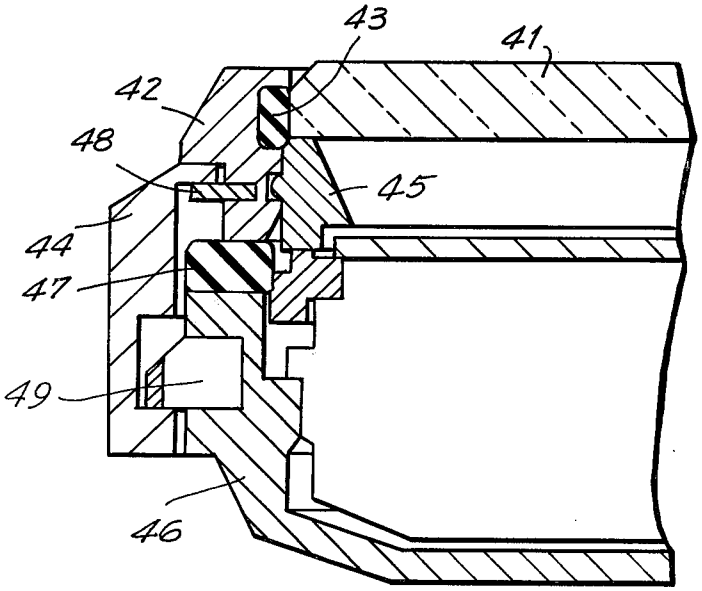
FIG. 8

WATERPROOF WATCH CASE

BACKGROUND OF THE INVENTION

As is well known, it is imperative that a watch case be impervious to moisture, since penetration of moisture into the movement can interfere with proper operation of the watch and, indeed, can completely ruin the watch. A variety of techniques have been used to prevent access of moisture to the interior of the watch, but these have not been completely satisfactory, due in part to complexity, in part to inadequate life and in part to unreliability. Naturally, all of these factors increase the cost of the watch, so that competitive advantage is lost.

As is evident, then, a simple, reliable and inexpensive method of assuring complete waterproofness is greatly to be desired.

SUMMARY OF THE INVENTION

A watch case is rendered waterproof through the use of a gasket which is compressed both radially and axially against the watch crystal by means of a bezel and a ring within said bezel. Further, a gasket is provided between the back cover and the bezel. The gasket between said back cover and said bezel is held in compression by means of a leaf spring positioned in a groove in the case band for axially biasing the back cover and the case band in opposite directions.

The bezel and the case band may be fixed to each other by a securing member which may be a linchpin or a spring which can be pressed into planar shape.

Accordingly, an object of the present invention is a waterproof watch case wherein the waterproofing characteristic is secured reliably and at low cost.

Another object of the present invention is a waterproof watch case which is free of cement and which depends for its waterproof characteristic on one or more gaskets.

A further object of the present invention is a waterproof watch case which may be of square, circular, ovoid or cloud shape.

An important object of the present invention is a waterproof watch case in which the watch crystal is held securely and positively in place by means of a gasket compressed both radially and axially against said watch crystal by a bezel and a ring.

An important object of the present invention is a waterproof watch case wherein biasing means are employed to thrust a case band and a back cover axially in opposite directions for the purpose of compressing gaskets.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 5*a*, 5*b* and 5*c* are different views of a spring for fixing the case band to the bezel;

FIGS. 6*a*, 6*b* and 6*c* are different views of a second embodiment of said spring;

FIGS. 7*a*, 7*b* and 7*c* are different views of a third embodiment of said spring; and FIG. 8 is a sectional view of a fourth embodiment of the present invention, in which the case band and the bezel are fixed together by means of a linchpin.

DESCRIPTION OF THE PREFERRED EMBODIMENTS

Figure 1:
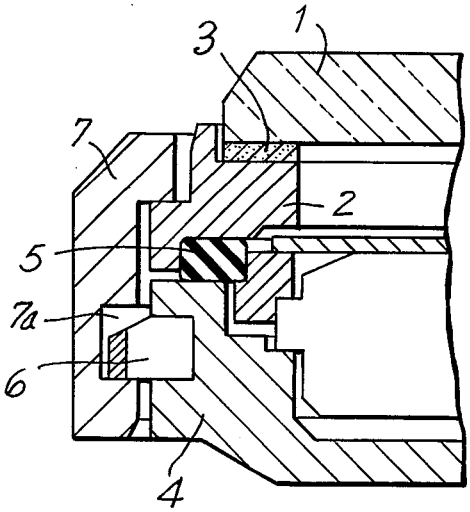
FIG. 1 PRIOR ART
FIG. 1 is a sectional view of a watch case in accordance with the prior art.

Conventionally, a square-shaped watch case, for example, is waterproofed as shown in FIG. 1, wherein watch crystal 1 is permanently joined to glass frame 2 by means of binding agent or cement 3. A back-cover gasket 5 is provided between the lower surface of glass frame 2 and the upper surface of back cover 4. Case band 7 and back cover 4 are engaged with each other by means of leaf spring 6, both ends of which are affixed to back cover 4 so as to be able to move radially. Leaf spring 6 engages case band 7 by means of groove or channel 7*a* so as to compress gasket 5 axially, thereby providing a waterproof connection between back cover 4 and glass frame 2.

The join between glass frame 2 and watch crystal 1 depends for its waterproofness on bonding agent or cement 3. However, during continued use, the cement ages and, moreover, deteriorates as the result of temperature change. Consequently, eventually, the join becomes porous and moisture enters the watch. Furthermore, should the glass be broken or damaged, so that it must be replaced, the cost of such replacement is relatively high, since both the glass and the glass frame to which it is joined must be replaced as a unit.

Watch cases constructed in accordance with the present invention avoid these difficulties by the use of a gasket between a glass bezel and the outer periphery of the watch crystal. The gasket is compressed from below by a glass ring and is compressed radially by a glass bezel. The combination of radial and axial compression provides a secure, waterproof join which locates the crystal positively and which has long life.

Figure 2:
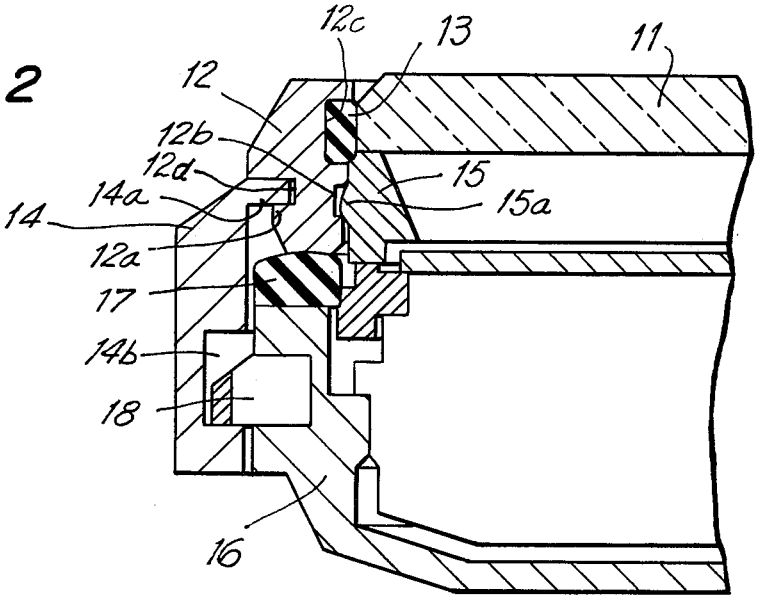
FIG. 2 is a sectional view of a embodiment of the present invention.

Referring now to FIG. 2, watch crystal 11 makes contact peripherally with gasket 13, which is held within groove 12*c* on the inner periphery of glass bezel 12. Lower portion 12*a* of glass bezel 12 engages lip portion 14*a* of case band 14 so that it is fixed to glass bezel 12 by groove 12*d* in said lip portion. Gasket 13 is pushed upward by glass ring 15 so that said gasket is compressed both radially and axially.

Outer peripheral ridge 15*a* of glass ring 15 is engaged by lower surface of groove 12*b* in glass bezel 12. As a result, glass bezel 12 and glass ring 15 move as a unit under upward thrust, and watch crystal 11 is positively located with respect to glass bezel 12.

Back-cover gasket 17 is disposed between glass bezel 12 and back cover 16. Case band 14 and back cover 16 engage each other through leaf spring 18, located in channel 14*b* of case band 14. Both ends of leaf spring 18 are secured to back cover 16 so that gasket 17 is pressed in the axial direction upwardly to make watertight join between back cover 16 and glass bezel 12. Watertightness throughout the entire watch is thus ensured as the result of gaskets 13 and 17, both of which are continually under pressure provided by leaf spring 18. Furthermore, should the watch crystal be broken or damaged, so that it must be replaced, only the watch crystal itself need be replaced, thereby decreasing the cost below that involved in replacing a watch crystal in a construction such as is shown in FIG. 1. A further advantage of the construction results from the fact that the glass bezel 12 is separate from case band 14, so that glass bezel 12 and case band 14 can be easily produced in a variety of colors to make possible a wide variety of designs. Moreover, the shape of the watch case itself is unlimited because even if the glass is polygonal, curved as in an oval, or free-form shape, the glass bezels, glass rings and gaskets need only be shaped to conform to the watch crystal itself.

Figure 3:
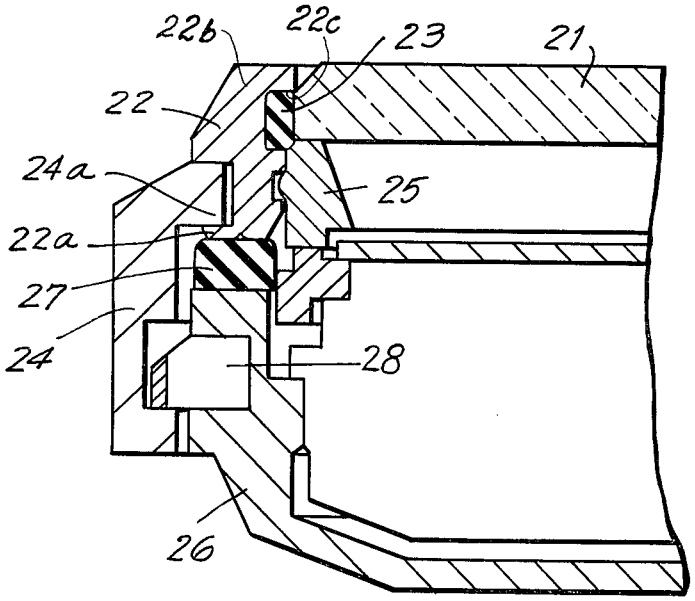
FIGS. 3 and 4 are further embodiments of the present invention.

In the embodiment of FIG. 3, glass ring 25 pushes gasket 23 upwardly to compress said gasket both axially and radially against watch crystal 21; glass bezel 22 and case band 24 are joined to each other by caulking, that is, lower portion 22*a* of glass bezel 22 is forced under ridge portion 24*a* of case band 24 by the use of caulking tools or the like, so that they are positively located with respect to each other. Gasket 23 and back-cover gasket 27 are compressed by back cover 26 and leaf spring 28 in a manner similar to that shown in FIG. 2. Through the use of these gaskets, certain watertightness is achieved. In order that lower portion 22*a* may be forced under ridge portion 24*a*, glass bezel 22 must be of a malleable material, such as copper or a suitable plastic, examples being acrylonitrile-butadiene-styrene and some polyacetals.

Figure 4:
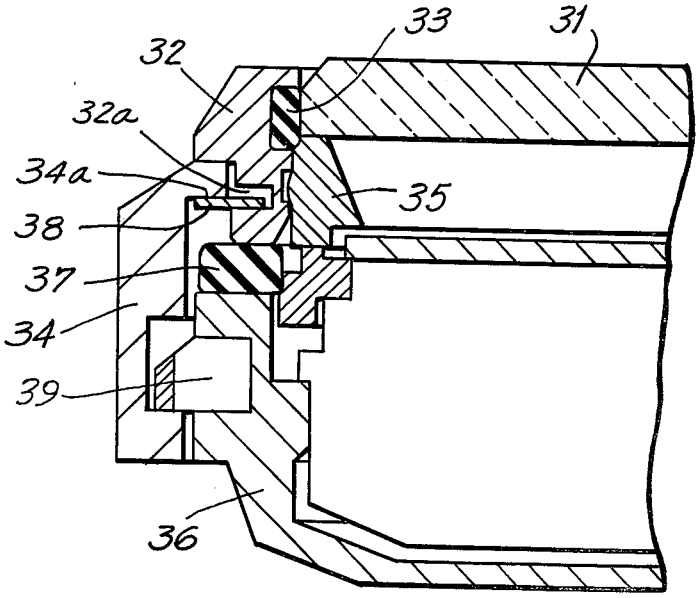

As shown in FIG. 4, glass bezel 32 and case band 34 are joined by a securing member 38, said securing member 38 being forced into planar shape to provide biasing action. The securing member 38, when not under compression, may have one of the shapes shown in FIGS. 5*a*, 5*b*, 5*c*, 6*a*, 6*b*, 6*c* and 7*a*, 7*b* and 7*c*. Through the use of this type of engagement, glass bezel 32 and case band 34 are fixed together as a unit. Portions 38*a*, 38*b* and 38*c* are respectively engaged with channel 32*a* in glass bezel 32, and portions 38*d*, 38*e* and 38*f* of securing member 38 press against surface 34*a* of case band 34. Watch crystal 31 is located against gasket 33 by glass ring 35, and back-cover gasket 37 seals back cover 36 to glass bezel 32 in the manner described in connection with the embodiments of FIGS. 2 and 3, back cover 36 being biased upwardly against gasket 37 by leaf spring 39.

In the embodiment of FIG. 8, watch crystal 41 is held by glass ring 45 and gasket 43, as in the other embodiments. Glass bezel 42 is fixed relative to case band 44 by means of linchpin 48. The number of pins should be at least two. Once more, watertightness is provided by gaskets 43 and 47, the latter sealing the join between back cover 46 and case band 44. Also, leaf spring 49 biases back cover 46 upwardly against gasket 47.

As can be seen from the foregoing, a construction is provided which is completely waterproof and maintains its watertightness for long periods. Moreover, the watch crystal can readily be replaced if damaged, without the necessity for replacing any other components. Finally, the cost of the construction is low.

It should be noted that in the embodiment of FIG. 3, the smallest interior diameter of glass bezel 22 is smaller than the major diameter of watch crystal 21. For this construction, the watch crystal 21 is inserted from the rear of the watch and, as shown in FIG. 3, watch crystal 21 is located against lower face 22*c* of groove 22*c'* in glass bezel 22.

It will thus be seen that the objects set forth above, among those made apparent from the preceding description, are efficiently attained, and since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A waterproof watch case, comprising a watch crystal, a glass bezel surrounding said crystal, said bezel having first and second grooves therein, said first groove facing said watch crystal, first gasket means in said first groove, a glass ring inside said bezel and below said crystal and having a ridge thereon mating with said second groove for pressing said gasket against the periphery of said watch crystal for forming a waterproof seal between said watch crystal and said glass bezel and for locating said watch crystal with respect to said bezel, a case band, fixing means holding said case band to said glass bezel in fixed relationship, a back cover, second gasket means between said back cover and said glass bezel, and biasing means between said case band and said back cover for biasing said back cover axially upward to form a waterproof seal between said back cover and said glass bezel.

2. The waterproof watch case as defined in claim 1, wherein said biasing means is a leaf spring.

3. The waterproof watch case as defined in claim 1, wherein said fixing means is a non-planar sheet compressed into planar form.

4. The waterproof watch case as defined in claim 1, wherein said fixing means is an interior lip on said case band.

5. The waterproof watch case as defined in claim 1, wherein said glass bezel is of a material which is malleable and said fixing means is a portion of said glass bezel between said back cover and said second gasket means.

6. The waterproof watch case as defined in claim 1, wherein said fixing means is a plurality of linchpins joining said case band to said glass bezel.

* * * * *